US011220915B2

(12) United States Patent
Geisen et al.

(10) Patent No.: US 11,220,915 B2
(45) Date of Patent: Jan. 11, 2022

(54) COMPONENT WALL OF A HOT GAS COMPONENT

(71) Applicant: Siemens Energy Global GmbH & Co. KG, Munich (DE)

(72) Inventors: Ole Geisen, Berlin (DE); Michael Hajduk, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/048,584

(22) PCT Filed: Apr. 12, 2019

(86) PCT No.: PCT/EP2019/059392
§ 371 (c)(1),
(2) Date: Oct. 17, 2020

(87) PCT Pub. No.: WO2019/211082
PCT Pub. Date: Nov. 7, 2019

(65) Prior Publication Data

US 2021/0156262 A1 May 27, 2021

(30) Foreign Application Priority Data

May 4, 2018 (EP) ..... 18170851

(51) Int. Cl.
*F01D 5/18* (2006.01)
*F01D 9/04* (2006.01)
(Continued)

(52) U.S. Cl.
CPC ..... *F01D 5/18* (2013.01); *F01D 9/04* (2013.01); *F01D 25/12* (2013.01); *F01D 25/14* (2013.01);
(Continued)

(58) Field of Classification Search
CPC ..... F01D 5/186; F01D 5/189; F01D 9/041; F01D 25/12; F05D 2220/32;
(Continued)

(56) References Cited

U.S. PATENT DOCUMENTS 4,573,865 A * 3/1986 Hsia ..... F01D 5/187 165/109.1
9,683,444 B1 6/2017 Jones
(Continued)

FOREIGN PATENT DOCUMENTS

EP 0954680 B1 2/2002
EP 1990507 A1 11/2008
(Continued)

OTHER PUBLICATIONS

PCT International Search Report and Written Opinion of International Searching Authority dated Aug. 23, 2019 corresponding to PCT International Application No. PCT/EP2019/059392 filed Apr. 12, 2019.

*Primary Examiner* — Woody A Lee, Jr.
*Assistant Examiner* — Brian Christopher Delrue

(57) ABSTRACT

A component wall of a hot gas component for a gas turbine, which in a double-walled design, has an outer wall which is hotter and an inner wall which is cooler during operation. The interior is divided by partition walls extending between the inner and outer walls. A coolant flows into the interior through inlet openings in the inner wall and out through outlet openings in the outer wall. An inlet cavity is directly connected to at least one of the inlet openings without being directly connected to outlet openings. A second cavity is provided directly next to the inlet cavity. The second cavity is directly connected, as an outlet cavity, only to at least one of the outlet openings, without being directly connected to inlet openings. The partition wall has at least one through-
(Continued)

opening for conducting the coolant from the inlet cavity into the outlet cavity.

10 Claims, 6 Drawing Sheets

(51) Int. Cl.
*F01D 25/12* (2006.01)
*F01D 25/14* (2006.01)
*F23R 3/04* (2006.01)

(52) U.S. Cl.
CPC ..... *F23R 3/04* (2013.01); *F05D 2220/32* (2013.01); *F05D 2230/31* (2013.01); *F05D 2240/12* (2013.01); *F05D 2240/14* (2013.01); *F05D 2240/30* (2013.01); *F05D 2240/35* (2013.01); *F05D 2260/201* (2013.01); *F05D 2260/231* (2013.01)

(58) Field of Classification Search
CPC ..... F05D 2240/12; F05D 2240/122; F05D 2240/124; F05D 2240/30; F05D 2260/201; F05D 2260/202; Y02T 50/672; Y02T 50/676
See application file for complete search history.

(56) References Cited

U.S. PATENT DOCUMENTS

| | | | | |
|---|---|---|---|---|
| 10,550,701 | B2 * | 2/2020 | Kiener | F01D 5/187 |
| 2005/0150632 | A1 | 7/2005 | Mayer et al. | |
| 2016/0222796 | A1 * | 8/2016 | Spangler | F01D 5/187 |
| 2020/0277860 | A1 * | 9/2020 | Gross | F01D 5/186 |

FOREIGN PATENT DOCUMENTS

| | | | | |
|---|---|---|---|---|
| WO | 9825009 | A1 | 6/1998 | |
| WO | WO-2017009051 | A1 * | 1/2017 | F01D 5/187 |

* cited by examiner

COMPONENT WALL OF A HOT GAS COMPONENT

CROSS REFERENCE TO RELATED APPLICATIONS

This application is the US National Stage of International Application No. PCT/EP2019/059392 filed 12 Apr. 2019, and claims the benefit thereof. The International Application claims the benefit of European Application No. EP18170851 filed 4 May 2018. All of the applications are incorporated by reference herein in their entirety.

FIELD OF INVENTION

The invention relates to a component wall of a hot-gas component for a gas turbine, which, in a double-walled design, comprises an outer wall, which is hotter during operation, and an inner wall, which is colder during operation, and whose interior space arranged therebetween is basically subdivided by partition walls extending between the inner wall and the outer wall, wherein a coolant is able to flow into the interior space through inlet openings arranged in the inner wall and is able to flow out of the interior space through outlet openings arranged in the outer wall.

BACKGROUND OF INVENTION

A component wall of said type is used, for example as per EP 0 954 680 B1, in a turbine blade. In particular, the component wall is the component wall of an airfoil, which airfoil is provided, aerodynamically curved, for diverting a hot gas flowing in a gas turbine. Provided in the interior of the hollow component wall are so-called heat transfer elements, by way of which the outer wall, which is heated during operation, can be cooled with cooling air owing to the flow through the hollow component wall. U.S. Pat. No. 4,573,865, moreover, discloses cascaded impingement cooling in a monolithic heat shield.

However, it has been found that a turbine blade of said type, whose outer wall is exposed to a significantly higher temperature than the inner, and thus cooler, wall, can have very large temperature gradients between the outside and the inside. Said temperature gradients in the material of the component wall result in thermally induced stresses, which can significantly reduce the service life of the turbine blade or can significantly limit the maximum permissible number of starts thereof.

EP 1 990 507 A1, U.S. Pat. No. 9,683,444 and US 2005/0150632 A1, moreover, each disclose heat shields having impingement cooling plates mounted thereon. EP 1 990 507 A1, in particular, also describes cascaded impingement cooling of the hot wall of the heat shield.

SUMMARY OF INVENTION

It is an object of the invention to specify a component wall of a hot-gas component for a gas turbine that has a relatively long service life.

According to the invention, the object is achieved by such a component wall which has in the interior space at least one first cavity which is directly connected, as an inlet cavity, only to at least one of the inlet openings, without being directly connected to outlet openings, and for which, immediately adjacent to the at least one inlet cavity, provision is made of at least one second cavity which is directly connected, as an outlet cavity, only to at least one of the outlet openings, without being directly connected to inlet openings, for which, with the formation of a flow path, the partition wall subdividing the respective inlet cavity from the outlet cavity adjacent thereto has at least one through-opening for conducting the coolant from the respective inlet cavity into the outlet cavity, and for which at least one means which, during the intended use of the component wall, brings about an increase in the material temperature of the inner wall in a targeted manner is provided.

Consequently, the interior space is subdivided into at least one inlet cavity, advantageously multiple inlet cavities, and into at least one outlet cavity, advantageously multiple outlet cavities, which are in each case assigned specific openings: only inlet openings but no outlet openings are adjacent to the inlet cavity, and only outlet openings but no inlet openings are adjacent to the outlet cavity. With the aid of the partition walls, improved conduction of heat from the outer wall to the inner wall can be realized, so that in this way the temperature gradient can be reduced.

The inlet opening is advantageously configured for impingement cooling of the outer wall, which is hotter during operation, whereby a particularly effective reduction in the temperature of the outer wall is brought about. Furthermore, as a means for increasing the temperature of the inner wall, the partition wall having at least one through-opening is advantageously configured for jet impingement on the inner wall, which is cooler during operation, in the region of the outlet cavity by coolant which is heated during operation. In this case, the through-openings arranged in the partition wall are oriented not toward the outer wall but toward the inner wall, so that, as impingement openings, they can guide the heated coolant in a jet-like manner toward the inner wall and can thus increase the temperature of said inner wall, in particular in comparison with a component wall without such measures.

Consequently, the invention follows the approach of not only reducing the temperature of the outer wall as much as possible so as to reduce the temperature gradient between the inner wall and the outer wall. The invention follows the approach of also increasing the temperature of the inner wall, in order to reduce the temperature gradient of the entire component wall from the lower material temperature too and consequently, overall, to make the temperatures of the inner wall and the outer wall so close that service life-shortening stresses due to thermal expansions are reduced. Consequently, the invention rejects the concept of avoiding heating of the inner wall. The invention therefore proposes increasing the temperature of the inner wall in a targeted manner by way of at least one means intended for this purpose.

The component wall is monolithic, that is to say the inner wall, outer wall and partition walls are integral. Such a component wall may be manufactured by additive manufacturing methods, and in particular by selective laser melting. By contrast to previous impingement-cooled component walls, in the case of the component wall according to the invention, the outer wall, partition walls and impingement cooling wall are consequently produced simultaneously. It is possible in particular with such components for the temperature-induced material stresses to occur to an undesirably large extent, and so, with the invention, the service life of monolithic components in particular can be significantly increased.

Further advantageous measures are listed in the dependent claims and may be combined with one another in any desired manner so as to obtain further advantages.

The temperature gradient between the inner wall and the outer wall and consequently the resulting thermomechanical stresses in the component wall can be reduced further if, as means, provision is made on an inner surface, delimiting the outlet cavity, of the inner wall of elements for stimulating the transfer of heat. Said elements can then also serve for targeted heating of the comparatively colder inner wall, which leads to said result. The means for increasing the material temperature of the inner wall, that is to say the jet impingement on the inner wall by heated coolant or the elements for adaptation of the heat transfer, may be used as alternatives or in a manner complementing one another.

It goes without saying that the component wall comprises not merely a single inlet cavity and a single outlet cavity but multiple inlet cavities and multiple outlet cavities, and also multiple partition walls, which subdivide the interior space accordingly, and also multiple inlet openings and multiple outlet openings, such that, along a transverse extent of the component wall, inlet cavities and outlet cavities are arranged so as to constantly alternate with one another, wherein at least every second partition wall, which subdivides the interior space accordingly, in each case has at least one through-opening, advantageously multiple through-openings, for conducting coolant from the respective inlet cavity into the immediately adjacent outlet cavity. This configuration serves for large-area matching of the temperatures of the inner wall and the outer wall, while simultaneously achieving a sufficiently cooled outer wall. It is furthermore advantageous if the outlet cavity is delimited by two partition walls from two inlet cavities adjacent on both sides, and through-openings are arranged in only one of the two respective partition walls. In this way, it is possible to avoid, where expedient, combining of coolant flows from two inlet cavities flanking a respective outlet cavity. This results in a dedicated flow path for coolant for each pairing of an outlet cavity with an inlet cavity.

In order to achieve areal cooling of the outer wall, and an areal reduction in the temperature gradient between the outer wall and the inner wall, in a second dimension, for example in a longitudinal extent of the component wall, each of the inlet cavities is directly connected to in each case multiple inlet openings and each of the outlet cavities is directly connected to in each case multiple outlet openings and in each case multiple through-openings are arranged in the respective partition walls therebetween. Along said longitudinal extent of the component wall, the inlet openings or the outlet openings are advantageously arranged offset from the through-openings situated in the flow path. This makes possible firstly jet impingement on the outer wall with the aid of the inlet openings, and secondly jet impingement on the inner wall with the aid of the through-opening and sectionally convective cooling of the respective surfaces, along the longitudinal extent of the cavities.

Of particular advantage is that configuration in which the alternately arranged inlet cavities and outlet cavities, with the formation of multiple flow paths, are each formed to be triangular and at the same time arranged so as to overlap one another. This is to be understood as meaning that the inlet cavities bear with one corner of their triangular contour against the inner wall, while their edge which is opposite said corner is part of the outer wall. At the same time, the outlet cavity/cavities has/have a reversed orientation: one corner of the triangular outlet cavities bears against the outer wall, while one edge, opposite said corner, of the triangularly formed outlet cavity then constitutes part of the inner wall. In other words: the inner wall for the most part delimits the outlet cavities, and the outer wall for the most part delimits the inlet cavities, with the result that the inlet cavities are adjacent to the inner wall in a more pointwise manner, and the outlet cavities are adjacent to the outer wall in a more pointwise manner. This arrangement, in particular if it is provided in a repeated manner, has the advantage that the outer wall can be impingement-cooled over a large area by way of the inlet cavities. At the same time, the temperature of the inner wall, by way of the advantageous jet impingement on the inner wall, can, because of the through-openings arranged in the partition wall, be controlled by a coolant already heated, because of the impingement cooling of the outer wall, such that the temperature of the inner wall approaches the temperature of the outer wall. In this way, the service life of the component wall of a hot-gas component for a gas turbine is lengthened. Furthermore, this geometry increases the stiffness of the component wall.

Particularly advantageously, a hot-gas component has a corresponding component wall. The hot-gas component may for example be a turbine blade, designed as a guide vane or as a rotor blade. Here, the component wall may be part of the airfoil and/or else part of the platform. It goes without saying that the hot-gas component may also be designed as an annular segment or as a heat shield of a combustion chamber. Further applications are also conceivable.

BRIEF DESCRIPTION OF THE DRAWINGS

Further advantages and configurations of the invention will be described and discussed in more detail below on the basis of the exemplary embodiments illustrated in the figures, in which.

DETAILED DESCRIPTION OF INVENTION

In all the figures, features having an identical effect are denoted by the same reference signs.

Figure 1:
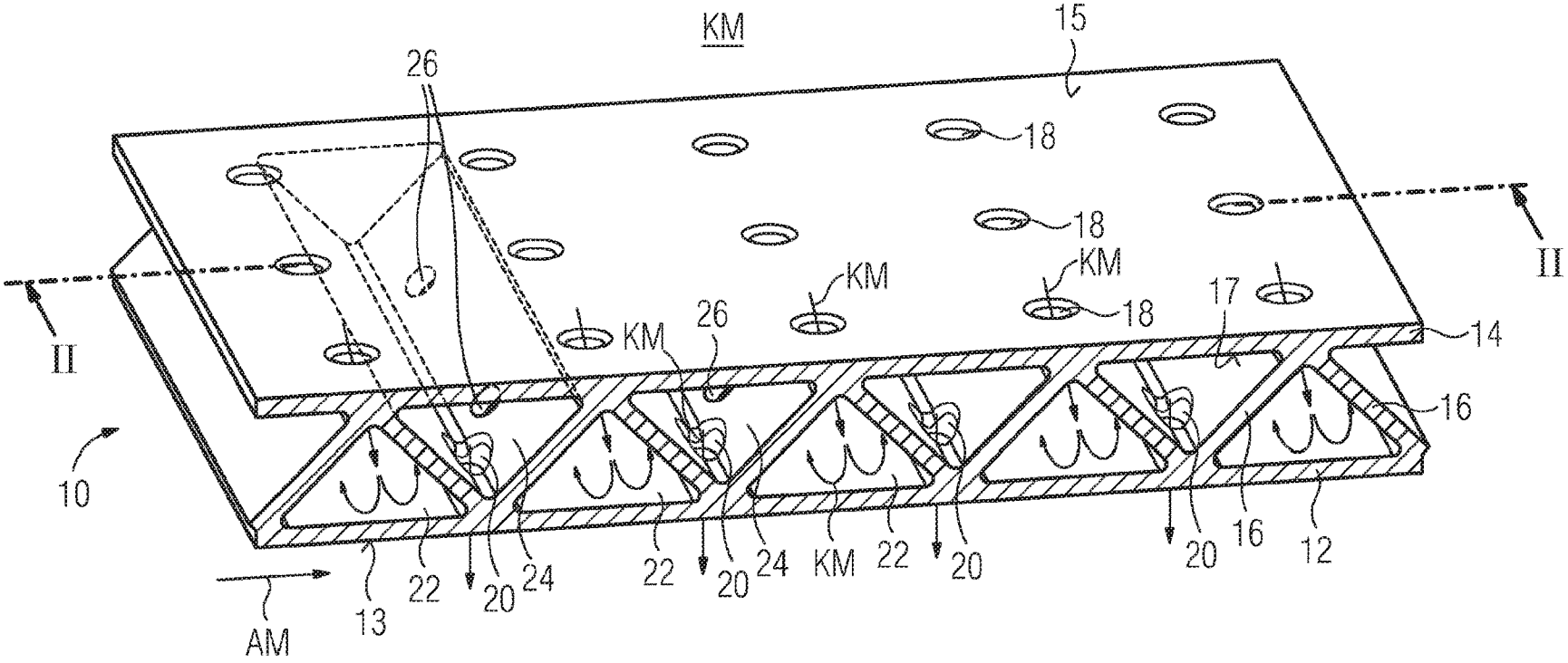
FIG. 1 shows, in a perspective illustration, a section through a component wall according to the invention of a hot-gas component for a gas turbine, as per a first exemplary embodiment.

FIG. 1 shows, in a perspective illustration, a section through a component wall 10 according to the invention. The component wall 10 is part of a hot-gas component (not illustrated further), which can be inserted in a gas turbine into its hot-gas path or for delimiting the latter. The component wall 10 is of double-walled design and has an outer wall 12, which is hotter during operation, and an inner wall 14, which is colder during operation. The terms "hotter" and "colder" relate in each case to the other wall: the outer wall has a higher temperature than the inner wall during operation and is thus hotter, whereas the inner wall has a lower temperature than the outer wall during operation. The inner wall is therefore the colder one. An interior space is arranged between the outer wall 12 and the inner wall 14 and is basically subdivided by partition walls 16 extending between the inner wall 14 and the outer wall 12. "Basically" means that in some or all the partition walls in each case at least one through-opening 26, advantageously multiple through-openings 26, are provided. Furthermore, a multiplicity of inlet openings 18 is provided in the inner wall 14 and a multiplicity of outlet openings 20 is provided in the outer wall 12. Overall, the component wall 10 is of sandwich design.

According to the first exemplary embodiment, the partition walls 16 arranged in the interior space are arranged obliquely such that a zigzag-like profile is established. This results in cross-sectionally triangular cavities 22, 24. The cavities 22, which are directly connected to the inlet openings 18, are referred to as inlet cavities, whereas the cavities 24, which are directly connected to the outlet openings 20, are referred to as outlet cavities. The inlet cavities 22 are directly fluidically connected only to the inlet openings 18 and the through-openings 26. Also, the outlet cavities 24 are directly connected only to the outlet openings 20 and the through-openings 26. The term "directly" means immediately mutually adjacently.

The shape of the inlet cavities 22 and outlet cavities 24 correspond to the shape of an isosceles triangle, and so these are able to be arranged in a complementary manner.

During the intended use of the hot-gas component having the component wall 10 shown, a hot working medium AM flows along the outwardly facing surface 13 of the outer wall 12. During this time, a coolant KM is simultaneously present on a surface 15 of the inner wall 14 that faces away from the interior space of the component wall 10. During operation, the coolant KM present on the surface 15 flows into the inlet cavity 22 via the inlet openings 18 while forming individual coolant jets. The outer wall 12 is then impingement-cooled, which lowers the temperature level of the outer wall 12 over a large area and heats the coolant KM. Subsequently, the coolant KM flows to the through-openings 26, which are arranged in an offset manner, and flows through these into one of the immediately adjacent outlet cavities 24. Afterwards, said coolant, while forming further coolant jets, strikes an inner surface 17, delimiting the outlet cavity 24, of the inner wall 14. The heated coolant KM then heats the inner wall 14, so that the temperature of the latter increases. The temperature difference between the inner wall 14 and the outer wall 12 is consequently reduced, with the result that thermally induced stresses in the component or in the component wall 10 are reduced. The coolant KM then flows to the outlet openings 20 and exits the double-walled component wall 10 through these.

Figure 2:
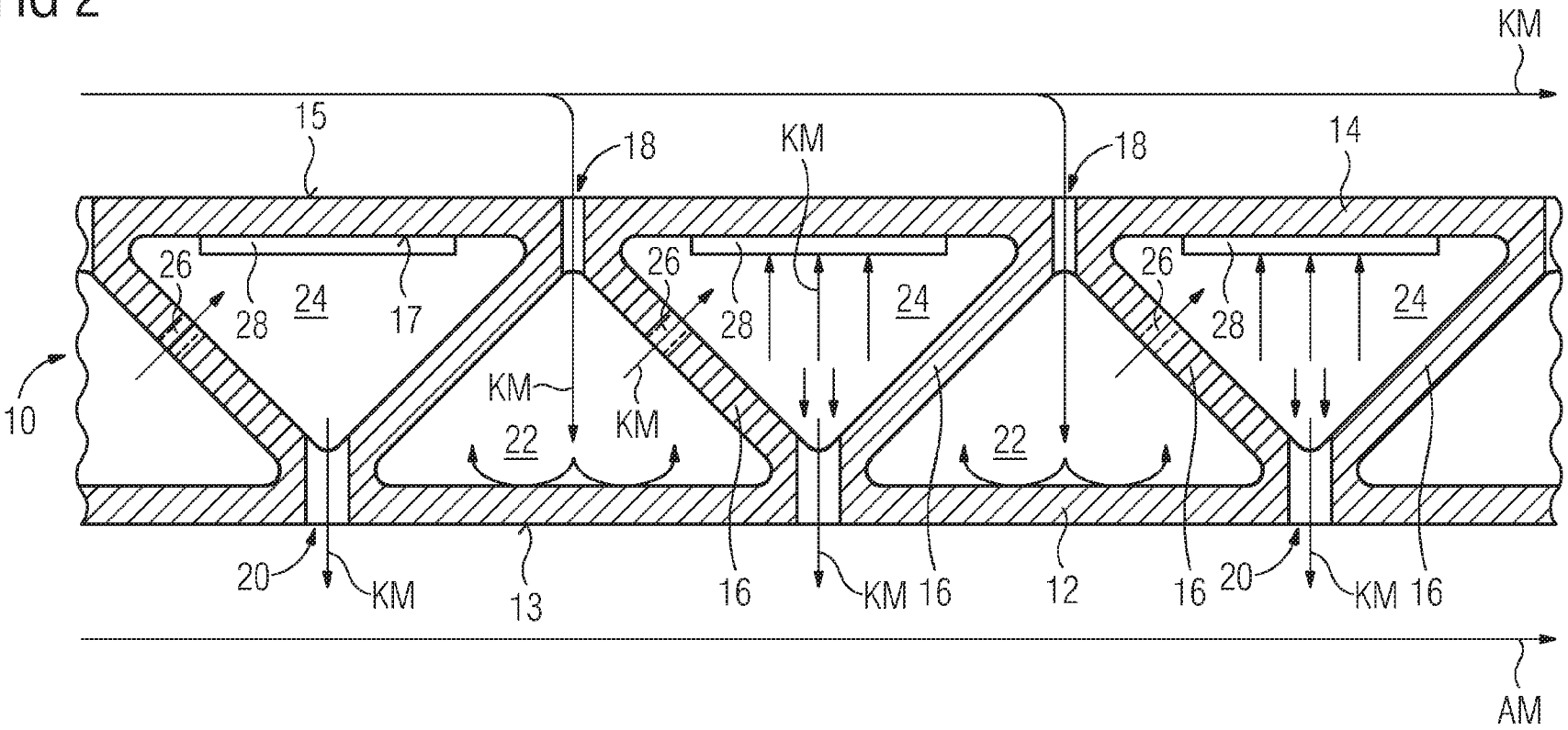
FIG. 2 shows a cross section through the component wall as per FIG. 1.

FIG. 2 shows the section through the hot-gas component as per the first exemplary embodiment along the section line II-II. As a supplement to the first exemplary embodiment, provision is made on the inner surfaces 17, delimiting the outlet cavities 24, of the inner wall 14 of elements 28 for stimulating the transfer of heat. Said elements 28 may be present for example in the form of turbulators, rib-like elevations or else pedestals. The use of these elements further contributes to the reduction of the temperature gradient between the inside and the outside. It is basically unimportant whether the stimulation of the transfer of heat occurs because of the enlarged surface and/or because of the more turbulent flow. Both variants have their own advantages.

Figure 3:
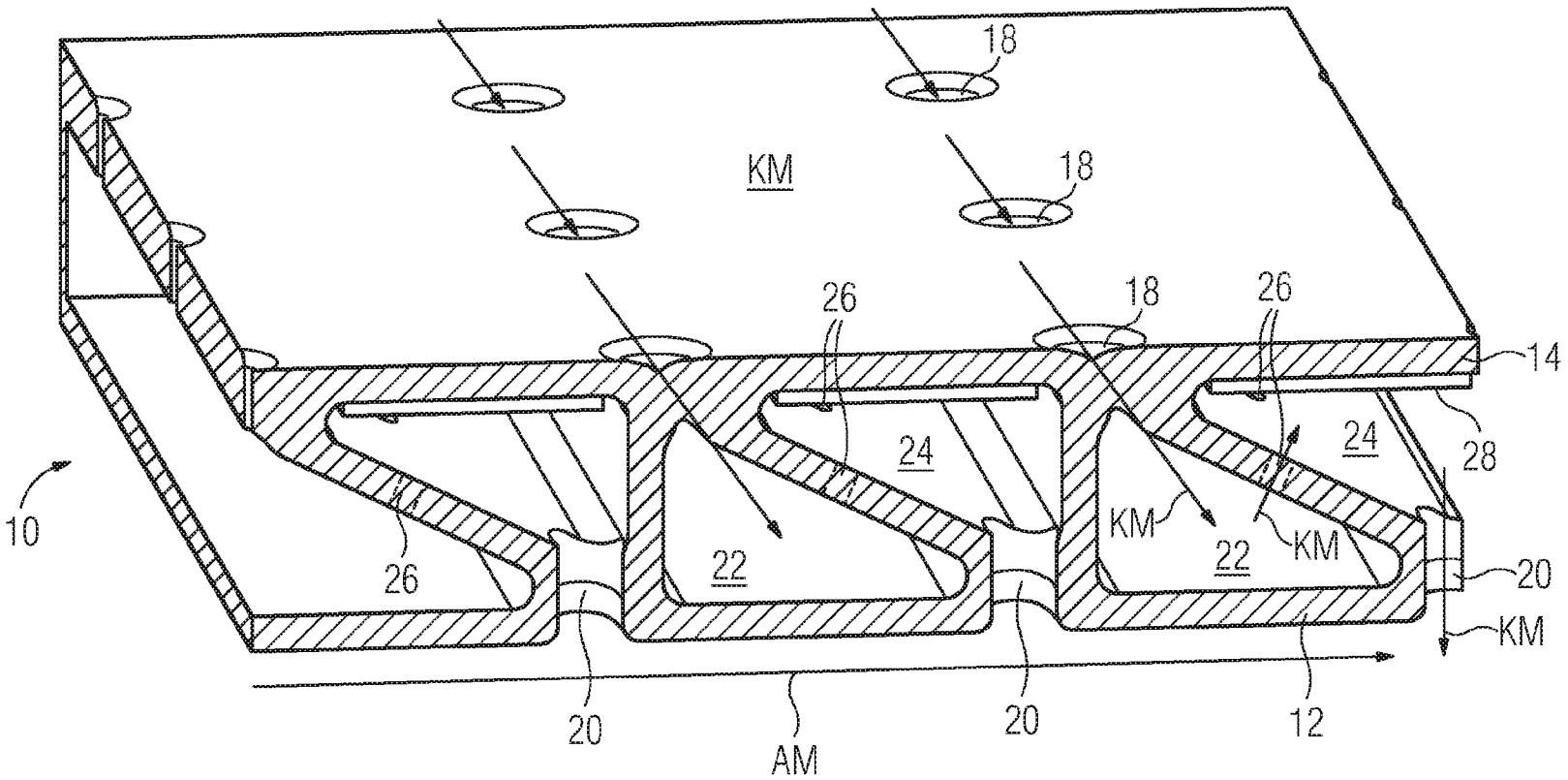
FIG. 3 shows, in a perspective illustration, the section through a component wall as per a second exemplary embodiment.

FIG. 3 shows an illustration, analogous to FIG. 1, of a component wall 10 as per a second exemplary embodiment. It is not the case that each of the partition walls 16 subdividing the inlet cavities 22 from the outlet cavities 24 extends obliquely from the inner wall 14 to the outer wall 12. As per the exemplary embodiment shown here, every second partition wall 16 projects perpendicularly from the inner walls 14 and outer walls 12, while the remainder are arranged obliquely. By contrast to the first exemplary embodiment with shapes of isosceles triangles, the inlet cavities 22 and outlet cavities 24, which are combinable in pairs, each have, as per the second exemplary embodiment in FIG. 3, the shape of a substantially right-angled triangle, which, combined in pairs, form a rectangular shape. What is common to both exemplary embodiments is that the inlet openings 18 and the outlet openings 20 are arranged in a corner region of the triangles, whereas those surfaces of the inlet cavities 22 which are subjected to jet impingement are then parts of the outer wall 12, and those surfaces of the outlet cavities 24 which are subjected to jet impingement are then parts of the inner wall 14. This makes it possible to achieve in each case the largest possible surface for jet impingement on the outer wall 12 and the inner wall 14, and thus to substantially avoid temperature gradients along the inner wall 14 or along the outer wall 12.

Figure 4:
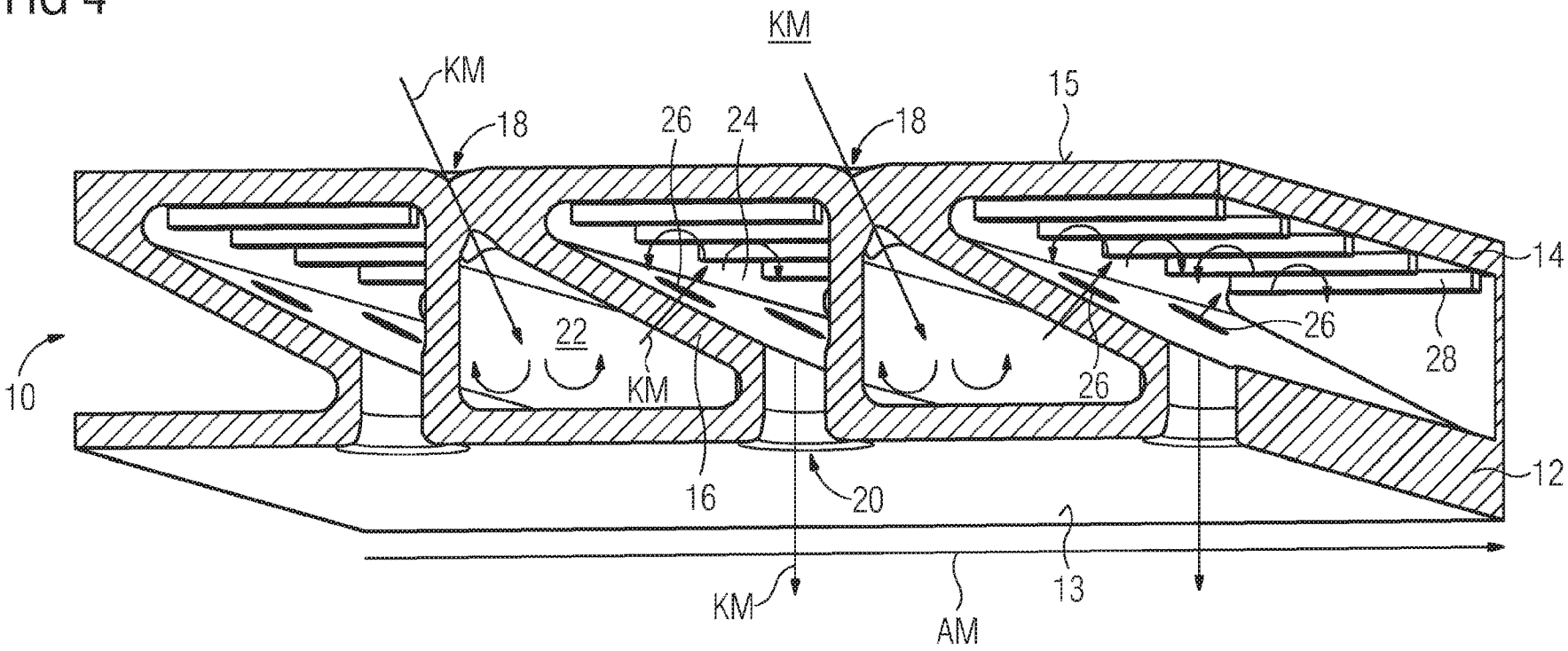
FIG. 4 shows, in a perspective illustration, a cross section through a component wall as per the second exemplary embodiment.

FIG. 4 shows the arrangement of rib-like turbulators 28 on the inner surfaces 17, delimiting the outlet cavity 24, of the inner wall 14.

Figure 5:
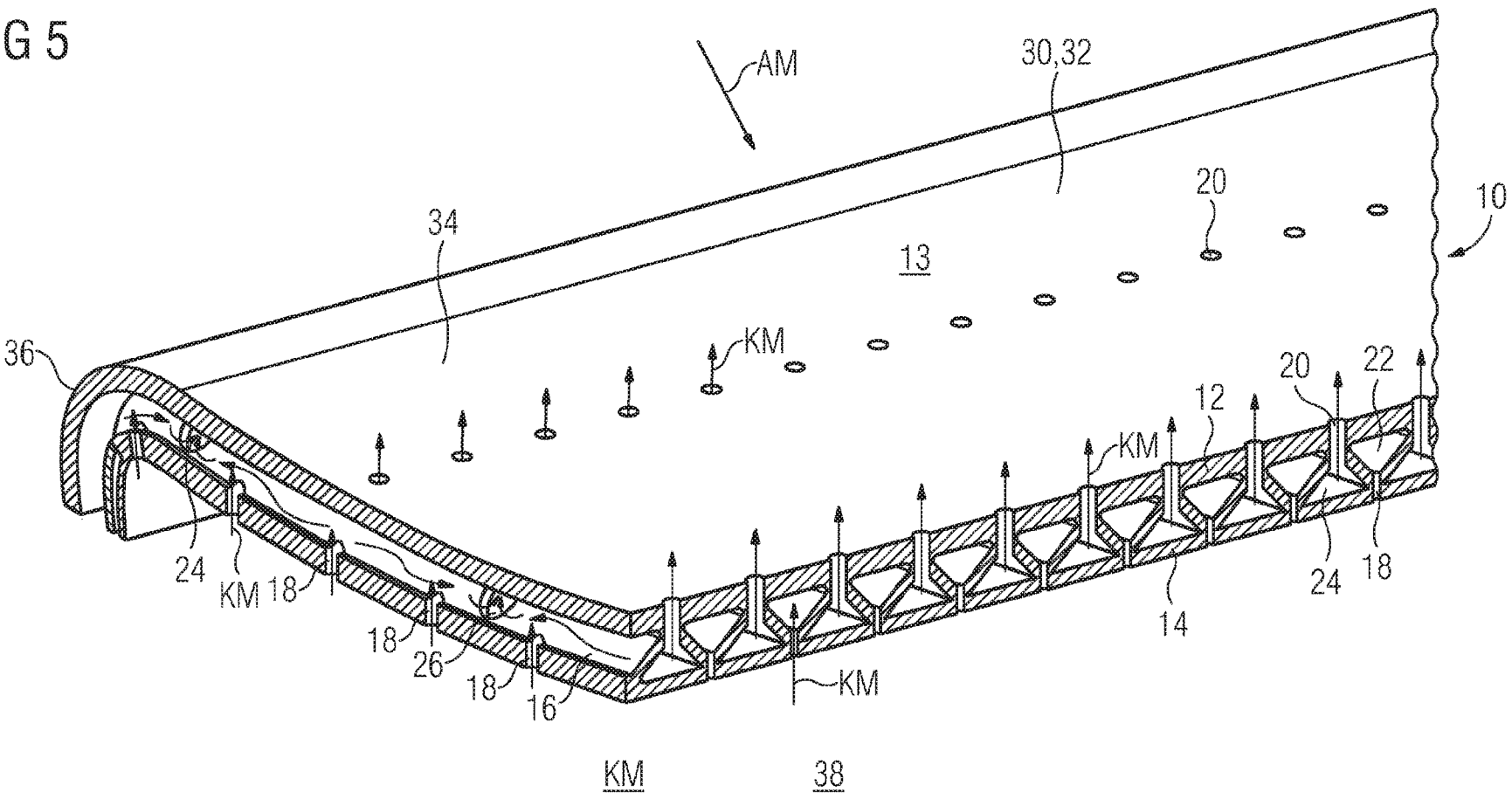
FIG. 5 shows a cross section through the airfoil of a turbine blade as a third exemplary embodiment of a component wall, wherein the section is realized longitudinally through the inlet cavity.
Figure 6:
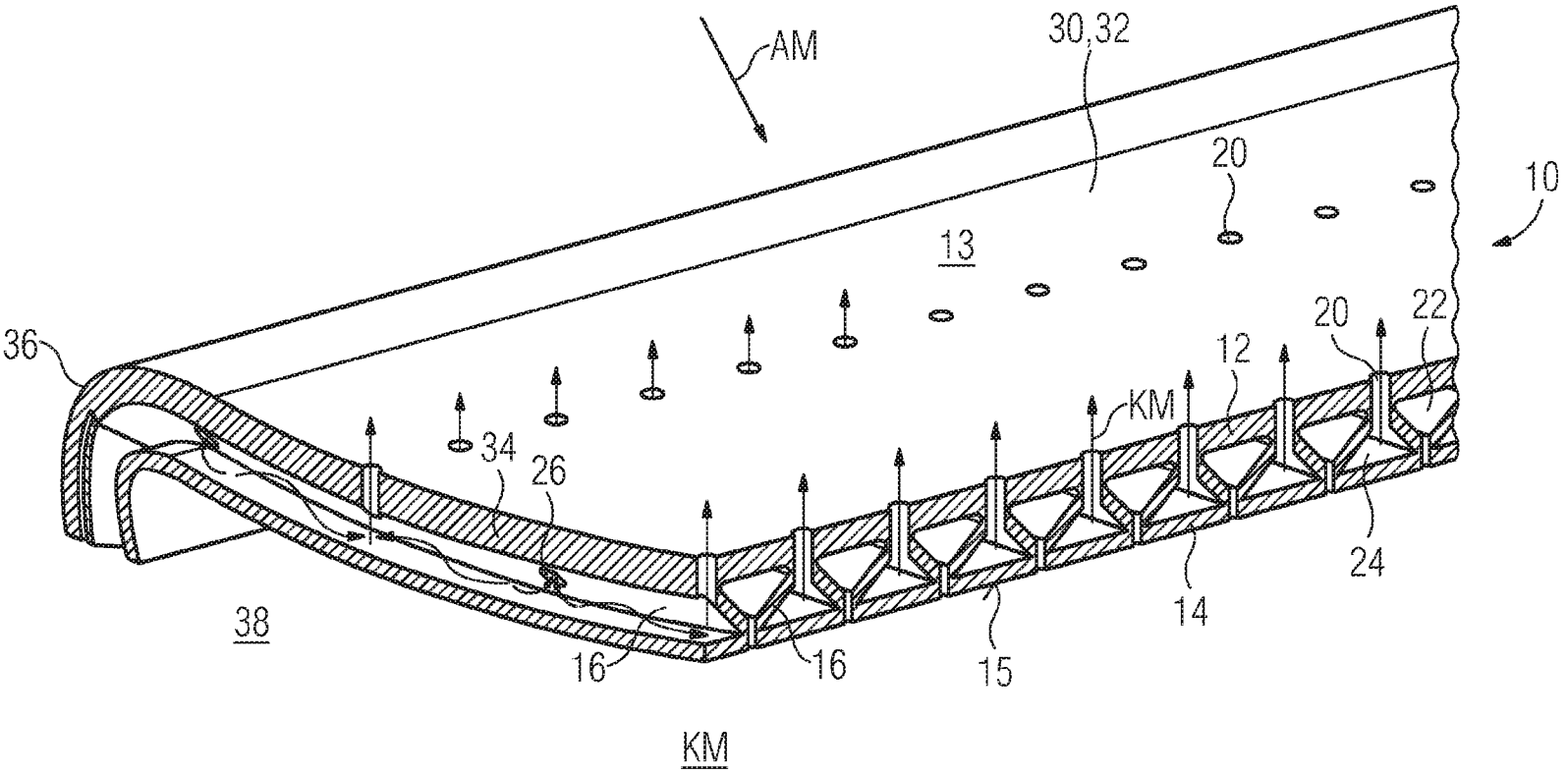
FIG. 6 shows the turbine blade as per FIG. 5 as the third exemplary embodiment of a component wall, with a section arranged through the outlet cavity.

FIGS. 5 and 6 show, in a perspective illustration, a part of an aerodynamically curved airfoil 30 of a turbine blade 32, with a section through the blade profile. Firstly, the pressure-side wall 34 of the airfoil 30 and the leading edge 36 of the latter are illustrated. Furthermore, the airfoil 30 comprises a suction-side wall and a trailing edge (neither illustrated).

As per this third exemplary embodiment of a double-walled component wall 10, the inlet cavities 22 and the outlet cavities 24 extend along a profile midline (not illustrated). The pressure-side wall 34 and the suction-side wall enclose a supply cavity 38 which is arranged in the interior of the airfoil 30 and to which the coolant KM is fed via a blade root (not illustrated). As already described above, said coolant may flow via inlet openings 18, in an impingement-cooling manner, into the interior space of the component wall 10 or of the pressure-side wall 34. The coolant KM subsequently flows to the through-openings 26 and then passes into the outlet cavity 24, from where it flows to the outlet openings 20. The coolant KM exits the component wall 10 or the turbine blade through said outlet openings and is then mixed with the working medium AM which flows around the airfoil 30.

It is particularly advantageous that, with the aid of the additive method of selective laser melting, a relatively thin component wall 10 can be provided. Wall thicknesses of an order of magnitude of 0.5 mm are conceivable. Moreover, the walls, designed to be hollow in such a way, can allow areal impingement cooling of the outer wall 12 without thermomechanical stresses, which shorten the service life, simultaneously occurring because of an impermissibly high temperature gradient. It is consequently possible to realize wall thicknesses of an order of magnitude of approximately 2.5 mm for the component wall 10 according to the invention. By contrast to conventionally manufactured impingement-cooled turbine components, in the case of which an outer wall normally produced by casting and a separately manufactured impingement cooling plate are paired with one another, the component wall 10 with a monolithic sandwich design results not only in an overall lower average metal temperature but also in a more homogeneous temperature distribution over the complete structure and thus in lower thermal stresses. Furthermore, the sandwich geometry provides effective stiffening of the component and reduces the weight thereof.

Finally, it should be mentioned that the illustrated exemplary embodiments, with regard to their size and density of openings and cavities, are merely of an exemplary nature.

Altogether, the invention relates to a component wall 10 of a hot-gas component for a gas turbine, which, in a double-walled design, comprises an outer wall 12, which is hotter during operation, and an inner wall 14, which is colder during operation, and whose interior space arranged therebetween is basically subdivided by partition walls 16 extending between the inner wall and the outer wall, wherein a coolant KM is able to flow into the interior space through inlet openings 18 arranged in the inner wall 14 and is able to flow out of the interior space through outlet openings 20 arranged in the outer wall 12. For the purpose of specifying a component wall with a lengthened service life and smaller temperature gradients, it is proposed which is directly connected, as an inlet cavity 22, only to at least one of the inlet openings 18, without being directly connected to outlet openings 20, and that, immediately adjacent to the at least one inlet cavity 22, provision is made of at least one second cavity which is directly connected, as an outlet cavity 24, only to at least one of the outlet openings 20, without being directly connected to inlet openings 18, and that the partition wall 16 subdividing the respective inlet cavity and the outlet cavity 24 adjacent thereto has at least one through-opening 26 for conducting the coolant KM from the respective inlet cavity 22 into the outlet cavity 24.

The invention claimed is:

1. A component wall of a hot-gas component for a gas turbine, which, in a monolithically double-walled design, comprises:

an outer wall, which is hotter during operation, and an inner wall, which is colder during operation, and whose interior space arranged therebetween is basically subdivided by partition walls extending between the inner wall and the outer wall, wherein a coolant is able to flow into the interior space through inlet openings arranged in the inner wall and is able to flow out of the interior space through outlet openings arranged in the outer wall, wherein provision is made in the interior space of at least one first cavity which is directly connected, as an inlet cavity, only to at least one of the inlet openings, without being directly connected to outlet openings, and wherein, immediately adjacent to the at least one inlet cavity, provision is made of at least one second cavity which is directly connected, as an outlet cavity, only to at least one of the outlet openings, without being directly connected to inlet openings, wherein the partition wall subdividing the respective inlet cavity from the outlet cavity adjacent thereto has at least one through-opening for conducting the coolant from the respective inlet cavity into the outlet cavity, and wherein at least one means is provided for increasing the material temperature of the inner wall.

2. The component wall as claimed in claim 1, further comprising:

multiple inlet cavities and multiple outlet cavities and also multiple partition walls, which subdivide the interior space accordingly, as well as multiple inlet openings and multiple outlet openings, wherein along a transverse extent of the component wall, inlet cavities and outlet cavities are arranged so as to alternate with one another, and at least every second partition wall, which subdivides the interior space accordingly, in each case has at least one through-opening for conducting coolant from the respective inlet cavity into the immediately adjacent outlet cavity.

3. The component wall as claimed in claim 1, wherein the respective inlet cavity and the at least one inlet opening assigned thereto are configured for impingement cooling of the outer wall, which is hotter during operation.

4. The component wall as claimed in claim 1, wherein, as a means, the partition wall having at least one through-opening is configured for jet impingement on the inner wall, which is cooler during operation, in the region of the outlet cavity by coolant which is heated during operation.

5. The component wall as claimed in claim 1, wherein, as means, provision is made on an inner surface, delimiting the outlet cavity, of the inner wall of elements for stimulating the transfer of heat.

6. The component wall as claimed in claim 1, wherein the outlet cavity is separated by two partition walls from two inlet cavities adjacent on both sides, and in that through-openings are arranged in only one of the two respective partition walls.

7. The component wall as claimed in claim 1, wherein each of the inlet cavities is directly connected to in each case multiple inlet openings and each of the outlet cavities is directly connected to in each case multiple outlet openings, and in which in each case multiple through-openings are arranged in the respective partition walls.

8. The component wall as claimed in claim 1, wherein alternately arranged inlet cavities and outlet cavities, with the formation of multiple flow paths, are each formed to be triangular in the wall section and arranged so as to at least partially overlap one another.

9. The component wall as claimed in claim 1, wherein the component wall is produced by an additive method.

10. A hot-gas component comprising:

a component wall which is designed as claimed in claim 1.

* * * * *